US008424989B2

(12) United States Patent
Kasahara

(10) Patent No.: US 8,424,989 B2
(45) Date of Patent: Apr. 23, 2013

(54) LIQUID EJECTION DEVICE AND LIQUID EJECTION METHOD

(75) Inventor: Hirokazu Kasahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 266 days.

(21) Appl. No.: 13/045,858

(22) Filed: Mar. 11, 2011

(65) Prior Publication Data

US 2011/0254888 A1 Oct. 20, 2011

(30) Foreign Application Priority Data

Apr. 16, 2010 (JP) ..... 2010-094770

(51) Int. Cl.
*B41J 29/38* (2006.01)
*B41J 2/15* (2006.01)
*B41J 2/015* (2006.01)

(52) U.S. Cl.
USPC ..... 347/12; 347/9; 347/20; 347/40

(58) Field of Classification Search ..... 347/9, 12, 347/40, 19
See application file for complete search history.

(56) References Cited

U.S. PATENT DOCUMENTS 5,384,587 A * 1/1995 Takagi et al. ..... 347/41
6,846,064 B2 * 1/2005 Yamane ..... 347/40
2010/0053246 A1 3/2010 Kasahara et al.

FOREIGN PATENT DOCUMENTS

JP 09-138472 A 5/1997
JP 2010-058289 A 3/2010
JP 2010-076230 A 4/2010
JP 2010-179552 A 8/2010

* cited by examiner

*Primary Examiner* — Jason Uhlenhake
(74) *Attorney, Agent, or Firm* — Global IP Counselors, LLP

(57) ABSTRACT

In a printing device for discharging ink from a plurality of print heads and printing on a print medium, the print heads are arrayed in a direction orthogonal to a movement direction relative to the print medium so that overlapping areas are created which overlap in the movement direction. A change rate of the apportionment ratio between a first nozzle row of an upstream print head in the relative movement direction of the print medium and of a second nozzle row and a downstream print head in the ends in the overlapping areas is greater than the change rate of the apportionment ratio in the middle in the overlapping areas. Concentration irregularity occurring in the overlapping areas of the printed article can thereby be made inconspicuous.

3 Claims, 7 Drawing Sheets

| | * | 1st | 2nd | 3rd | 4th | 5th | 6th | 7th | 8th | * |
|---|---|---|---|---|---|---|---|---|---|---|
| APPORTIONMENT RATIO A (%) | 100 | 70 | 60 | 55 | 51.5 | 48.5 | 45 | 40 | 30 | 0 |
| DIFFERENCE (%) | 30 | 10 | 5 | 3.5 | 3 | 3.5 | 5 | 10 | 30 | |
| APPORTIONMENT RATIO B (%) | 0 | 30 | 40 | 45 | 48.5 | 51.5 | 55 | 60 | 70 | 0 |
| DIFFERENCE (%) | 30 | 10 | 5 | 3.5 | 3 | 3.5 | 5 | 10 | 30 | |

| | * | 1st | 2nd | 3rd | 4th | 5th | 6th | 7th | 8th | * |
|---|---|---|---|---|---|---|---|---|---|---|
| APPORTIONMENT RATIO A (%) | 100 | 89 | 78 | 67 | 56 | 44 | 33 | 22 | 11 | 0 |
| DIFFERENCE (%) | 11 | 11 | 11 | 11 | 12 | 11 | 11 | 11 | 11 | |
| APPORTIONMENT RATIO B (%) | 0 | 11 | 22 | 33 | 44 | 56 | 67 | 89 | 89 | 0 |
| DIFFERENCE (%) | 11 | 11 | 11 | 11 | 12 | 11 | 11 | 11 | 11 | |

LIQUID EJECTION DEVICE AND LIQUID EJECTION METHOD

CROSS-REFERENCE TO RELATED APPLICATIONS

This application claims priority to Japanese Patent Application No. 2010-094770 filed on Apr. 16, 2010. The entire disclosure of Japanese Patent Application No. 2010-094770 is hereby incorporated herein by reference.

BACKGROUND

1. Technical Field

The present invention relates to a liquid ejection device and a liquid ejection method.

2. Related Art

Liquid ejection devices are already known which comprise a movement mechanism for moving a medium in a movement direction relative to a head unit having a leading head and a trailing head; a leading nozzle row provided at one end of the leading head in an intersecting direction which intersects the movement direction, wherein nozzles are aligned in sequence from a first nozzle to an mth nozzle in a direction from the other end of the intersecting direction to the first end; a trailing nozzle row provided at the other end of the trailing head in the intersecting direction, wherein nozzles from a first nozzle to an mth nozzle are aligned in sequence in the intersecting direction, the nozzles being positioned downstream in the movement direction of the first nozzle through mth nozzle of the leading nozzle row; and a controller for ejecting liquid onto the medium moved in a relative fashion by the movement mechanism at an apportionment ratio A from the nozzles of the leading nozzle row and at an apportionment (1-A) from the nozzles of the trailing nozzle row corresponding to the leading nozzle row, and for forming a raster line by arraying a plurality of dots along the movement direction. See, for example, Japanese Laid-Open Patent Application Publication No. 9-138472.

SUMMARY

However, a problem is presented in the prior art insofar as the image formed on the medium has irregularities in concentration when there is deviation in the positions where the heads are attached.

The present invention was devised in view of such problems with the prior art, and an object thereof is to ensure that concentration irregularity in the image formed on the medium is inconspicuous when seen with the naked eye.

A first aspect for solving this problem is a liquid ejection device including a head unit, a movement mechanism, a leading nozzle row, a trailing nozzle row and a controller. The head unit has a leading head and a trailing head. The movement mechanism is configured to move a medium in a movement direction relative to the head unit. The leading nozzle row is disposed in a first end of the leading head in an intersecting direction that intersects the movement direction, the leading nozzle row including a prescribed number of nozzles from a first nozzle to an mth nozzle aligned in sequence in the intersecting direction from a second end side to a first end side of the leading nozzle row. The trailing nozzle row is disposed in a second end of the trailing head in the intersecting direction, the trailing nozzle row including the prescribed number of nozzles from a first nozzle to an mth nozzle aligned in sequence in the intersecting direction from the second end side to the first end side of the trailing nozzle row so that the first nozzle through the mth nozzle of the trailing nozzle row are respectively positioned downstream in the movement direction from the first nozzle through the mth nozzle of the leading nozzle row. The controller is configured to control the head unit to eject liquid onto the medium moved by the movement mechanism at a first apportionment ratio from the nozzles of the leading nozzle row and at a second apportionment ratio from the nozzles of the trailing nozzle row corresponding to the leading nozzle row, and to form a raster line by arraying a plurality of dots along the movement direction. The controller is configured to change the first apportionment ratio so that the first apportionment ratio decreases sequentially from the first nozzle to the mth nozzle, and so that a change rate of the first apportionment ratio in the nozzles positioned at the first and second ends of the leading nozzle row is greater than the change rate of the first apportionment rate in the nozzles positioned in the middle of the leading nozzle row. The controller is configured to change the second apportionment ratio so that the second apportionment ratio increases sequentially from the first nozzle to the mth nozzle, and so that a change rate of the second apportionment ratio in the nozzles positioned at the first and second ends of the trailing nozzle row is greater than the change rate of the second apportionment ration in the nozzles positioned in the middle of the trailing nozzle row.

Other characteristics of the present invention will be made clear in the specification and the description of the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
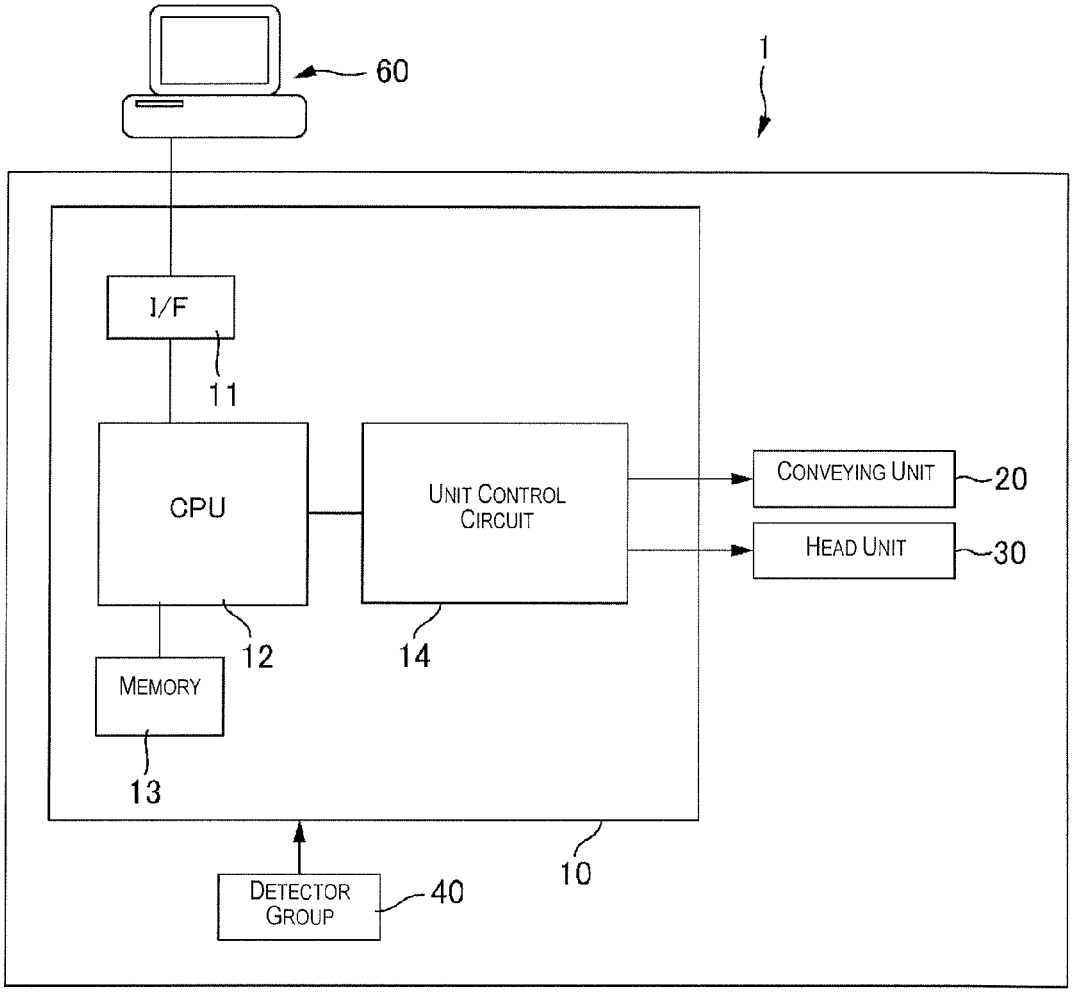
FIG. 1 is an overall structural block diagram of a printing system according to the present embodiment.

The following items at least are made clear from the description of the specification and the description of the accompanying drawings.

Specifically, there is provided A liquid ejection device including a head unit, a movement mechanism, a leading nozzle row, a trailing nozzle row, and a controller. The head unit has a leading head and a trailing head. The movement mechanism is configured to move a medium in a movement direction relative to the head unit. The leading nozzle row is disposed in a first end of the leading head in an intersecting direction that intersects the movement direction. The leading nozzle row includes a prescribed number of nozzles from a first nozzle to an mth nozzle aligned in sequence in the intersecting direction from a second end side to a first end side of the leading nozzle row. The trailing nozzle row is disposed in a second end of the trailing head in the intersecting direction. The trailing nozzle row includes the prescribed number of nozzles from a first nozzle to an mth nozzle aligned in sequence in the intersecting direction from the second end side to the first end side of the trailing nozzle row so that the first nozzle through the mth nozzle of the trailing nozzle row are respectively positioned downstream in the movement direction from the first nozzle through the mth nozzle of the leading nozzle row. The controller is configured to control the head unit to eject liquid onto the medium moved by the movement mechanism at a first apportionment ratio from the nozzles of the leading nozzle row and at a second apportionment ratio from the nozzles of the trailing nozzle row corresponding to the leading nozzle row, and to form a raster line by arraying a plurality of dots along the movement direction. The controller is configured to change the first apportionment ratio so that the first apportionment ratio decreases sequentially from the first nozzle to the mth nozzle, and so that a change rate of the first apportionment ratio in the nozzles positioned at the first and second ends of the leading nozzle row is greater than the change rate of the first apportionment rate in the nozzles positioned in the middle of the leading nozzle row. The controller is configured to change the second apportionment ratio so that the second apportionment ratio increases sequentially from the first nozzle to the mth nozzle, and so that a change rate of the second apportionment ratio in the nozzles positioned at the first and second ends of the trailing nozzle row is greater than the change rate of the second apportionment ration in the nozzles positioned in the middle of the trailing nozzle row.

According to such a liquid ejection device, concentration irregularity in the image formed on the medium can be made inconspicuous when viewed with the naked eye.

In this liquid ejection device, the controller may be configured to decrease the change rates of the first apportionment ratio and the second apportionment ratio progressively from the nozzles positioned at the first end of the leading nozzle row and the trailing nozzle row towards the nozzles positioned in the middle of the leading nozzle row and the trailing nozzle row, and to increase the change rates of the first apportionment ratio and the second apportionment ratio progressively from the nozzles positioned in the middle of the leading nozzle row and the trailing nozzle row towards the nozzles positioned at the second end of the leading nozzle row and the trailing nozzle row.

According to such a liquid ejection device, concentration irregularity in the image formed on the medium can be made inconspicuous when viewed with the naked eye.

According to the embodiment, a liquid ejection method includes: providing a movement mechanism configured to move a medium in a movement direction relative to a head unit including a leading head and a trailing head; providing a leading nozzle row disposed in a first end of the leading head in an intersecting direction that intersects the movement direction, the leading nozzle row including a prescribed number of nozzles from a first nozzle to an mth nozzle aligned in sequence in the intersecting direction from a second end side to a first end side of the leading nozzle row; providing a trailing nozzle row disposed in a second end of the trailing head in the intersecting direction, the trailing nozzle row including the prescribed number of nozzles from a first nozzle to an mth nozzle aligned in sequence in the intersecting direction from the second end side to the first end side of the trailing nozzle row so that the first nozzle through the mth nozzle of the trailing nozzle row are respectively positioned downstream in the movement direction from the first nozzle through the mth nozzle of the leading nozzle row; and ejecting liquid from the head unit onto the medium while the medium is moved relative to the head unit by the movement mechanism at a first apportionment ratio from the nozzles of the leading nozzle row and at a second apportionment ratio from the nozzles of the trailing nozzle row corresponding to the leading nozzle row, and forming a raster line by arraying a plurality of dots along the movement direction; changing the first apportionment ratio so that the first apportionment ratio decreases sequentially from the first nozzle to the mth nozzle, and so that a change rate of the first apportionment ratio in the nozzles positioned at the first and second ends of the leading nozzle row is greater than the change rate of the first apportionment rate in the nozzles positioned in the middle of the leading nozzle row; and changing the second apportionment ratio so that the second apportionment ratio increases sequentially from the first nozzle to the mth nozzle, and so that a change rate of the second apportionment ratio in the nozzles positioned at the first and second ends of the trailing nozzle row is greater than the change rate of the second apportionment ration in the nozzles positioned in the middle of the trailing nozzle row.

According to such a liquid ejection method, concentration irregularity in the image formed on the medium can be made inconspicuous when viewed with the naked eye.

SUMMARY OF LIQUID EJECTION DEVICE ACCORDING TO PRESENT EMBODIMENT

Structural Example of Printing System

Figure 2A:
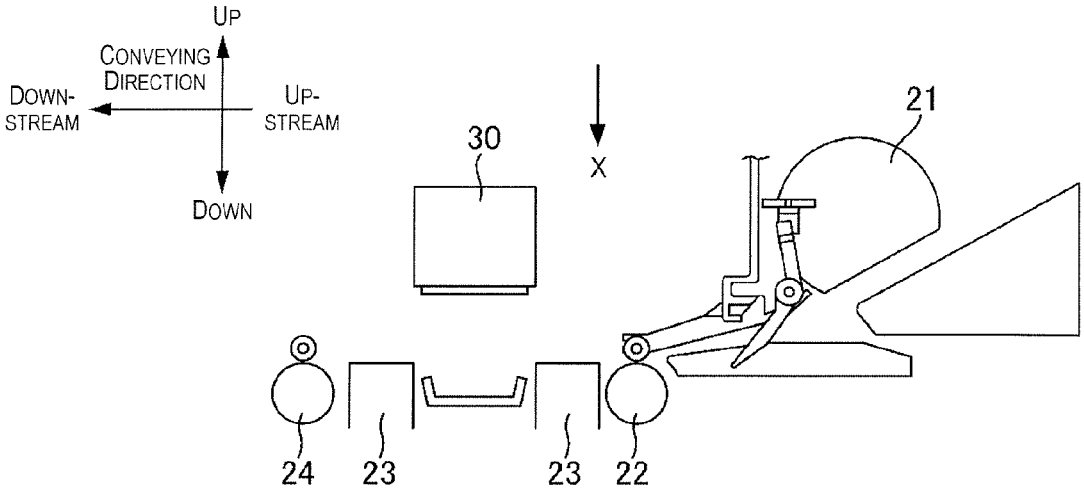
FIG. 2A is a cross-sectional view of a printer 1.
Figure 2B:
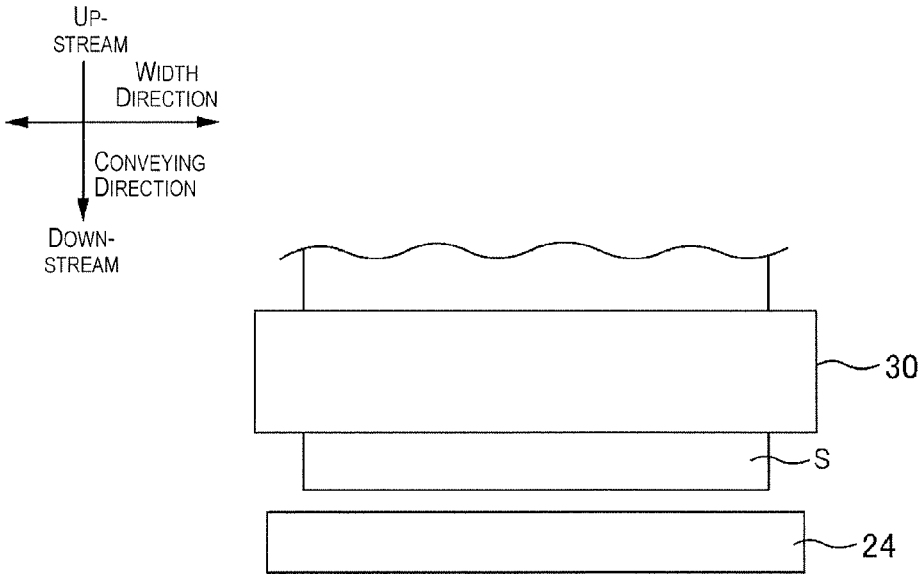
FIG. 2B is a drawing showing the manner in which the printer 1 conveys a paper S (a medium)
Figure 3:
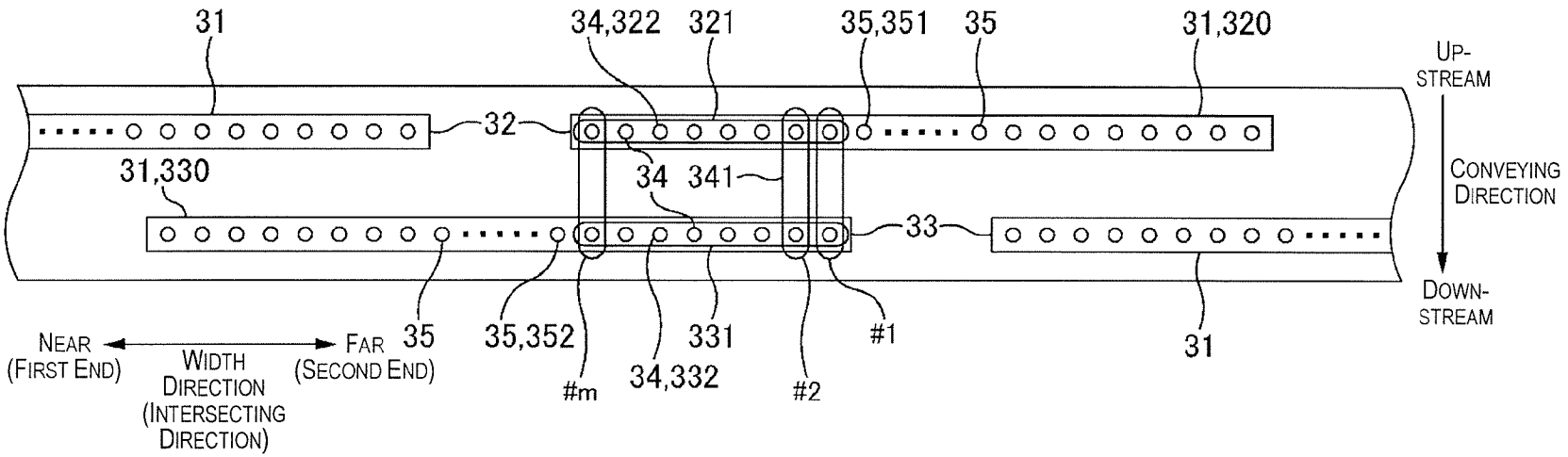
FIG. 3 is a schematic view showing the array of nozzles in the bottom surface of a head unit 30.

A structural example of the printing system will be described using FIGS. 1, 2A, 2B, and 3. FIG. 1 is an overall structural block diagram of the printing system according to the present embodiment. FIG. 2A is a cross-sectional view of a printer 1. FIG. 2B is a drawing showing the manner in which the printer 1 conveys a paper S (a medium). FIG. 3 is a schematic view showing the array of nozzles in the bottom surface of a head unit 30. FIG. 2B is a view of the head unit 30 and other components as seen from the direction X indicated in FIG. 2A.

The printing system comprises a computer 60 and a printing device as an example of the liquid ejection device (a line-head inkjet printer, hereinbelow referred to simply as a printer 1). The printing system including the printer 1 and the computer 60 can also be referred to in a broader sense as a "liquid ejection device."

The computer 60 comprises application software and a printer driver. The computer 60 converts the multi-tone image data created by the application software to binary print data. This conversion is achieved by image processing by the printer driver.

Having received the print data from the computer 60, the printer 1 controls various units (a conveying unit 20 as an example of the movement mechanism, a head unit 30, and the like) using a controller 10 and forms an image on the paper S as an example of a medium. The condition of the printer 1 is observed by a detector group 40, and the controller 10 controls the units on the basis of the detection results.

The controller 10 is a control unit for performing control on the printer 1. An interface 11 is used for sending and receiving data between the printer 1 and the computer 60, which is an external device. A CPU 12 is a calculation processing device for performing control on the entire printer 1. A memory 13 is used for ensuring there are areas for storing the programs of the CPU 12, operational areas, and the like. The CPU 12 controls the units using a unit control circuit 14 according to the programs stored in the memory 13.

The conveying unit 20 feeds the paper S to a printable position, and during printing conveys the paper S by a predetermined conveying amount in the movement direction (equivalent to the predetermined direction). The conveying unit 20 has a paper-feeding roller 21, a conveying roller 22, a platen 23, and a paper ejection roller 24, as shown in FIG. 2A. The paper-feeding roller 21 is a roller for feeding the paper S, which has been inserted into a paper insertion port, to the printer 1. The conveying roller 22 is a roller for conveying the paper S fed by the paper-feeding roller 21 to a printable area. The platen 23 supports the paper S during printing. The paper ejection roller 24 is a roller for ejecting the paper S out of the printer 1.

The head unit 30 is used for ejecting ink as an example of a liquid onto the paper S. The head unit 30 forms dots on the paper S and thereby prints an image on the paper S by ejecting ink onto the paper S being conveyed. The head unit 30 according to the present embodiment is capable of forming dots across the width of the paper all at once.

The configuration of the head unit 30 according to the present embodiment is described in detail while referring to FIG. 3. The head unit 30 comprises a plurality of heads 31. The bottom surfaces of the heads 31 are provided with pluralities of nozzles which are ink ejection units. The nozzles are aligned in pluralities (groups of 360 in the present embodiment) at fixed intervals (360 dpi) in the (paper) width direction (equivalent to the intersecting direction) which intersects the movement direction. The nozzles are provided with pressure chambers (not shown) where the ink enters, and drive elements (piezo elements) for ejecting the ink by varying the capacities of the pressure chambers.

The heads 31 are disposed in a zigzag alignment in the width direction. Specifically, the heads 31 are divided into upstream heads 32 which are positioned upstream in the movement direction, and downstream heads 33 which are positioned downstream in the movement direction. The upstream heads 32 and downstream heads 33 are aligned alternately in the width direction (in other words, . . . →upstream heads 32→downstream heads 33→upstream heads 32→ . . . ). The upstream heads 32 and the downstream heads 33 that are adjacent to each other in the width direction are also disposed so that the end of one head between an upstream head 32 and a downstream head 33 adjacent to each other overlaps the end of the other head in the width direction. The leading head 320 is provided with a nozzle row in which nozzles are aligned in the width direction, and the trailing head 330 is also provided with a nozzle row in which nozzles are aligned in the width direction.

When the upstream heads 32 shown by the symbol 320 in FIG. 3 are represented by the leading head 320 and the downstream heads 33 shown by the symbol 330 are represented by the trailing head 330, there is overlap in the width direction between a near end (equivalent to the end part of the first end side) in the width direction of the leading head 320 which is an upstream head 32, and a far end (equivalent to the end part of the second end side) in the width direction of the trailing head 330 which is a downstream head 33 positioned downstream from the leading head 320 in the width direction. The nozzles positioned in the overlapping area where the leading head 320 and the trailing head 330 overlap are referred to as overlapping nozzles 34, and the nozzles positioned in portions where the leading head 320 and the trailing head 330 do not overlap are referred to as non-overlapping nozzles 35. Among the overlapping nozzles 34, a number m (eight in the present embodiment) of nozzles positioned in the near end of the leading head 320 are referred to as leading nozzles 322, and the row containing these aligned m number of leading nozzles is referred to as the leading nozzle row 321. Also among the overlapping nozzles 34, the m number of nozzles positioned in the far end of the trailing head 330 are referred to as the trailing nozzles 332, and the row containing these aligned m number of trailing nozzles is referred to as the trailing nozzle row 331. Specifically, an m number of nozzle groups 341 (see FIG. 3) are formed in which the leading nozzles 322 and the trailing nozzles 332 are aligned in the movement direction. In other words, an m number of nozzle groups 341 are disposed beginning with a first nozzle group #1, and continuing from a second nozzle group #2 to an mth nozzle group #m in sequence from the far-side end (equivalent to the end part of the other end side) to the near-side end (equivalent to the end part of the first end), as shown in FIG. 3.

Printing Process Example

Using a printing process herein as an example, a printing process example will be described. Upon receiving a print directive and print data from the computer 60, controller 10 analyzes the contents of the various commands contained in the print data and uses the various units to perform the following process.

First, the controller 10 causes the paper-feeding roller 21 to rotate and feeds the paper S to be printed into the printer 1. The controller 10 then causes the conveying roller 22 to rotate and positions the fed paper S to a print-initiating position. At this time, the paper S faces at least some of the nozzles of the heads 31 (the preceding will be referred to as the first printing process step for the sake of convenience).

Next, the paper S is conveyed without interruption at a constant rate by the conveying roller 22 and passed underneath the heads 31 (on top of the platen 23). While the paper S is passing underneath the heads 31, ink is intermittently ejected from the nozzles. As a result, a dot row (raster line) composed of a plurality of dots running along the movement direction is formed on the paper S (the preceding will be referred to as the second printing process step for the sake of convenience).

Lastly, the controller 10 uses the paper ejection roller 24 to eject the paper S, on which image printing has ended (the preceding will be referred to as the third printing process step for the sake of convenience).

The second printing process step mentioned above will here be described further. In the printing process, the controller 10 ejects ink onto the conveyed paper S from the leading nozzles 322 and the trailing nozzles 332 belonging to the aforementioned nozzle groups 341, and forms a raster line for each nozzle group 341 by arraying pluralities of overlapping dots along the movement direction.

The amount of ink ejected from the nozzles in order to form the dots is established based on the print data. Specifically, when dots of the same concentration are formed, there is no difference in the amount of ink attempted to be ejected, whether the dots are formed by the non-overlapping nozzles 35 or by the overlapping nozzles 34 (the nozzle groups 341). When ink is ejected from the non-overlapping nozzles 35 and dots are formed, an amount of ink corresponding to the print data is ejected from one nozzle. When ink is ejected from the overlapping nozzles 34 (the nozzle groups 341) and dots are formed, an amount of ink corresponding to the print data is ejected from two nozzles (the leading nozzles 322 and the trailing nozzles 332), and the total amount of ink ejected from the two nozzles is equal to the amount of ink corresponding to the print data. Specifically, the nozzle groups 341 positioned in the overlapping nozzles 34 eject ink by distributing the load between two nozzles, one a leading nozzle 322 and one a trailing nozzle 332.

Using $\gamma$ to denote the total amount of ink ejected from both nozzles on the basis of the print data, the ink amount $\alpha$ ejected from the leading nozzle 322 in the nozzle groups 341 and the ink about $\beta$ ejected from the trailing nozzle 332 are found as follows, based on the apportionment ratio A (first apportionment ratio) and the apportionment ratio B (second apportionment ratio).

$$\alpha=\gamma\times A$$

$$\beta=\gamma\times B$$

The apportionment ratio A and the apportionment ratio B are established in advance for each of the nozzle groups 341 positioned in the overlapping nozzles 34, and are set in the present embodiment such that A+B=100%, for example. In the present embodiment, the change rate of A in the nozzles positioned at both ends of the leading nozzle row 321 and the trailing nozzle row 331 is established so as to be greater than the change rate of A in the nozzles positioned in the middle. The change in A is described hereinbelow using FIGS. 4 and 5. In the following description, the non-overlapping nozzles 35 eject ink in an amount corresponding to the print data with one nozzle, and the apportionment of the non-overlapping nozzles 35 is therefore 100%.

Figures 4, 5:
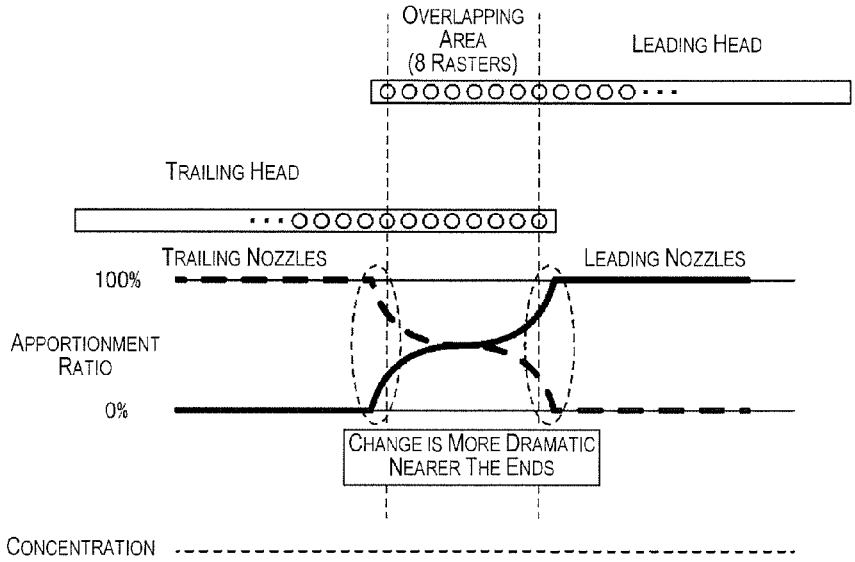
FIG. 4 is a graph showing the apportionment ratio A of leading nozzles and trailing nozzles in the nozzle groups.
FIG. 5 is a table showing the apportionment ratio A in the case of FIG. 4.

FIG. 4 is a graph showing the apportionment ratio A between the leading nozzles 322 and the trailing nozzles 332 of the nozzle groups 341, and FIG. 5 is a table showing the apportionment ratio A and the apportionment ratio B in the case in FIG. 4. The nozzle groups are aligned in sequence from the first nozzle group #1 to the eighth nozzle group #8 as shown in FIGS. 4 and 5, and the apportionment ratio A decreases up to 30% the first nozzle group #1 from the non-overlapping nozzles 35 (the nozzles 351 positioned in the upstream heads 32) to the first nozzle group #1, then decreases 10% from the first nozzle group #1 to the second nozzle group #2, further decreases 5% from the second nozzle group #2 to the third nozzle group #3, and the change rate becomes progressively smaller from the ends toward the middle. The apportionment ratio A decreases 3.5% from the third nozzle group #3 to the fourth nozzle group #4, decreases 3% from the fourth nozzle group #4 to the fifth nozzle group #5, decreases 3.5% from the fifth nozzle group #5 to the sixth nozzle group #6, and the change rate of the apportionment ratio A becomes smaller in the middle. However, the apportionment ratio A decreases 5% from the sixth nozzle group #6 to the seventh nozzle group #7, decreases 10% from the seventh nozzle group #7 to the eighth nozzle group #8, and further decreases 30% from the eighth nozzle group #8 to the non-overlapping nozzles 35 (the nozzles 352 positioned in the downstream heads 33), and the change rate of the apportionment ratio A becomes greater in the end part. As described above, the change in the apportionment ratio A is more dramatic in the end parts of the overlapping areas than in the middle.

The change rate of B in the nozzles positioned in the ends of the leading nozzle row 321 and the trailing nozzle row 331 is established so as to be greater than the change rate of B in the nozzles positioned in the middle.

The apportionment ratio B increases 30% from the non-overlapping nozzles 35 (the nozzles 351 positioned in the upstream heads 32) to the first nozzle group #1 as shown in FIG. 5, and then increases 10% from the first nozzle group #1 to the second nozzle group #2 and further increases 5% from the second nozzle group #2 to the third nozzle group #3, and the change rate becomes progressively smaller from the ends toward the middle. The apportionment ratio B increases 3.5% from the third embodiment to the fourth nozzle group #4, increases 3% from the fourth nozzle group #4 to the fifth nozzle group #5, increases 3.5% from the fifth nozzle group #5 to the sixth nozzle group #6, and the change rate of the apportionment ratio B becomes smaller in the middle. However, the apportionment ratio B increases 5% from the sixth nozzle group #6 to the seventh nozzle group #7, increases 10% from the seventh nozzle group #7 to the eighth nozzle group #8, and further increases 30% from the eighth nozzle group #8 to the non-overlapping nozzles 35 (the nozzles 352 positioned in the downstream heads 33), and the change rate of the apportionment ratio B becomes greater in the end part. As described above, the change in the apportionment ratio B is more dramatic in the end parts of the overlapping areas than in the middle.

Effectiveness

The printer 1 comprises a conveying unit 20 for moving a paper S in a movement direction relative to a head unit 30 having a leading head 320 and a trailing head 330; a leading nozzle row 321 of the leading head 320, the leading nozzle row 321 provided at one end of an intersecting direction, wherein the nozzles are aligned in sequence from a first nozzle to an mth nozzle in the direction toward the one end and away from another end of the intersecting direction; a trailing nozzle row 331 of the trailing head 330, the trailing nozzle row provided at another end of the intersecting direction, wherein the nozzles from a first nozzle to an mth nozzle, positioned downstream in the movement direction from the first nozzle through mth nozzle of the leading nozzle row 321, are aligned in sequence in the intersecting direction; and a controller 10 for ejecting ink onto the paper S moved in a relative manner by the conveying unit 20 at an apportionment ratio A from the nozzles of the leading nozzle row 321 and at an apportionment ratio B from the trailing nozzles 332 corresponding to the leading nozzles 322, and for forming a raster line by arraying a plurality of dots along the movement direction; wherein the controller 10, while changing A so that A decreases sequentially from the first nozzle to the mth nozzle, ejects ink so that the change rate of A in the nozzles positioned at both ends of the leading nozzle row 321 and the trailing nozzle row 331 is greater than the change rate of A in the nozzles positioned in the middle, and while changing B so that B increases sequentially from the first nozzle to the mth nozzle, the controller 10 ejects ink so that the change rate of B in the nozzles positioned at both ends of the leading nozzle row 321 and the trailing nozzle row 331 is greater than the change rate of B in the nozzles positioned in the middle, forming a raster line, whereby irregularity in the concentration in the image formed on the paper S can be made inconspicuous when viewed with the naked eye.

The present embodiment is compared hereinbelow with the prior art, and the effectiveness of the present embodiment is described.

Figures 6, 7:
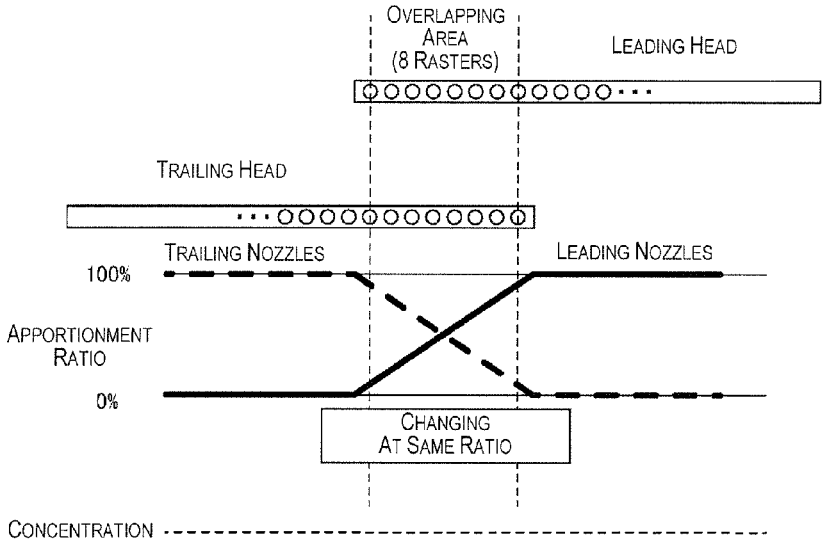
FIG. 6 is a graph showing the apportionment ratio A of leading nozzles and trailing nozzles of nozzle groups in a conventional printing process.
FIG. 7 is a table showing the apportionment ratio A in the case of FIG. 6.
Figure 8:
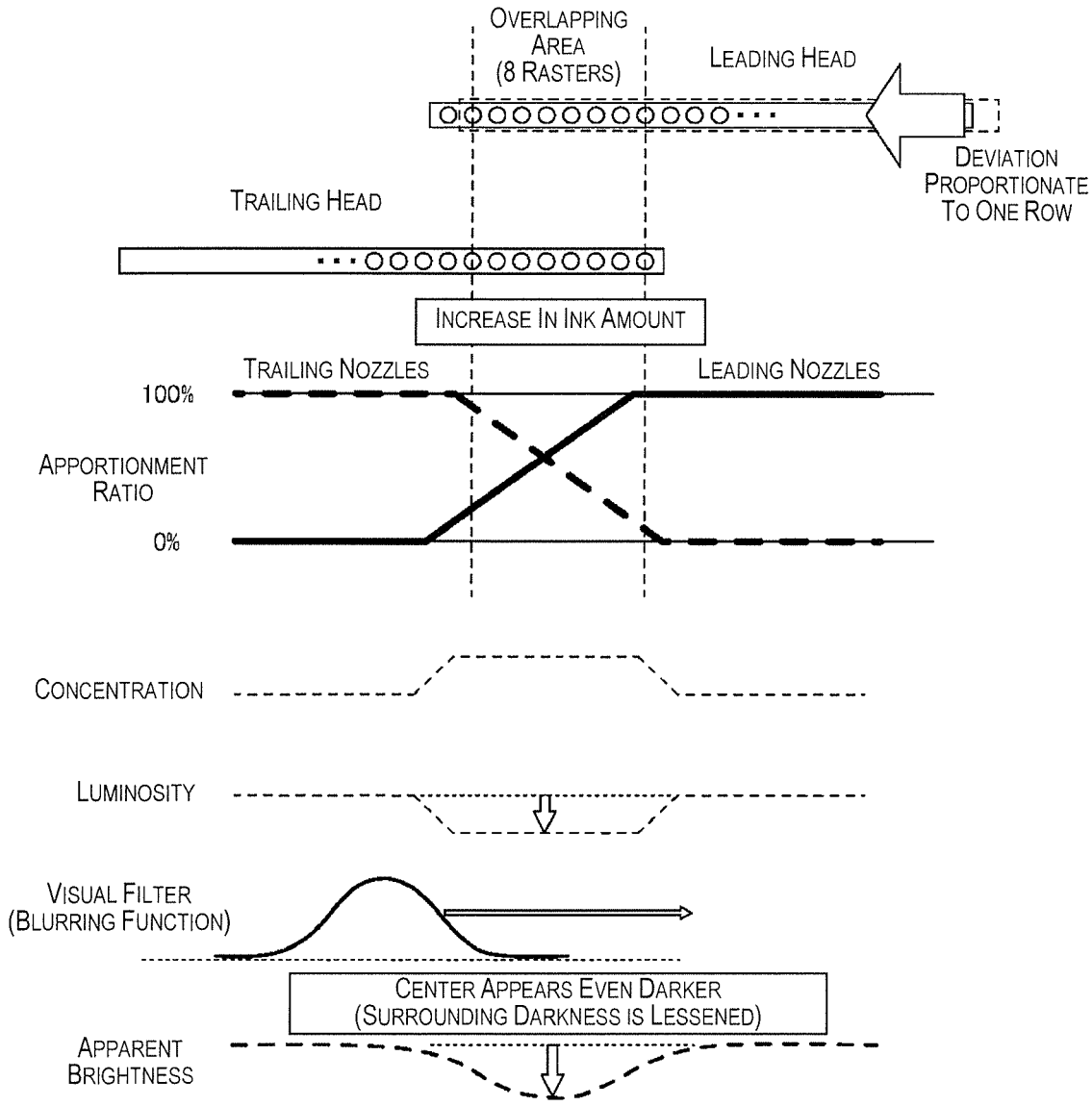
FIG. 8 is a diagram showing the luminosity of an image and the brightness when viewed with the naked eye (the apparent brightness) in a case of deviation in the attached positions of the heads in a printer provided with the printing process of the prior art.

FIG. 6 is a graph showing the apportionment ratio A of leading nozzles 322 and trailing nozzles 332 of the nozzle groups in the conventional printing process, and FIG. 7 is a table showing the apportionment ratio A in the case of FIG. 6. The nozzles are aligned sequentially from the first nozzle group #1 to the eighth nozzle group #8 as shown in FIGS. 6 and 7, but the apportionment ratio A gradually decreases from the first nozzle group #1 to the eighth nozzle group #8. FIG. 8 is a diagram showing the luminosity of an image and the brightness when viewed with the naked eye (the apparent brightness) in a case of deviation in the attached positions of the heads in a printer provided with the printing process of the prior art. In a case of relative deviation in the attached positions of the heads towards filling in one raster between the leading head 320 and the trailing head 330, for example, the amount of ink in the image printed by the nozzle groups 341 of the overlapping nozzles 34 (the "overlapping image" hereinbelow) increases uniformly over that of the image printed by the non-overlapping nozzles 35 (the "non-overlapping image" hereinbelow), and the concentration of the image decreases (i.e., luminosity decreases, the image appears darker), as shown in the diagram.

In the rasters in the overlapping image, the concentration is uniform, but when the overlapping image and the non-overlapping image are viewed as a whole with the naked eye, they will appear blurry depending on the visual features. Therefore, in the ends of the overlapping image, the visual features cause the darkness of the image to lessen due to the effects from the adjacent non-overlapping image. Since such lessening effects do not occur in the center of the overlapping image, the center of the overlapping image appears particularly dark. Specifically, due to the center of the overlapping image appearing particularly dark, the overlapping image becomes conspicuous as concentration irregularity in the overall image.

Figure 9:
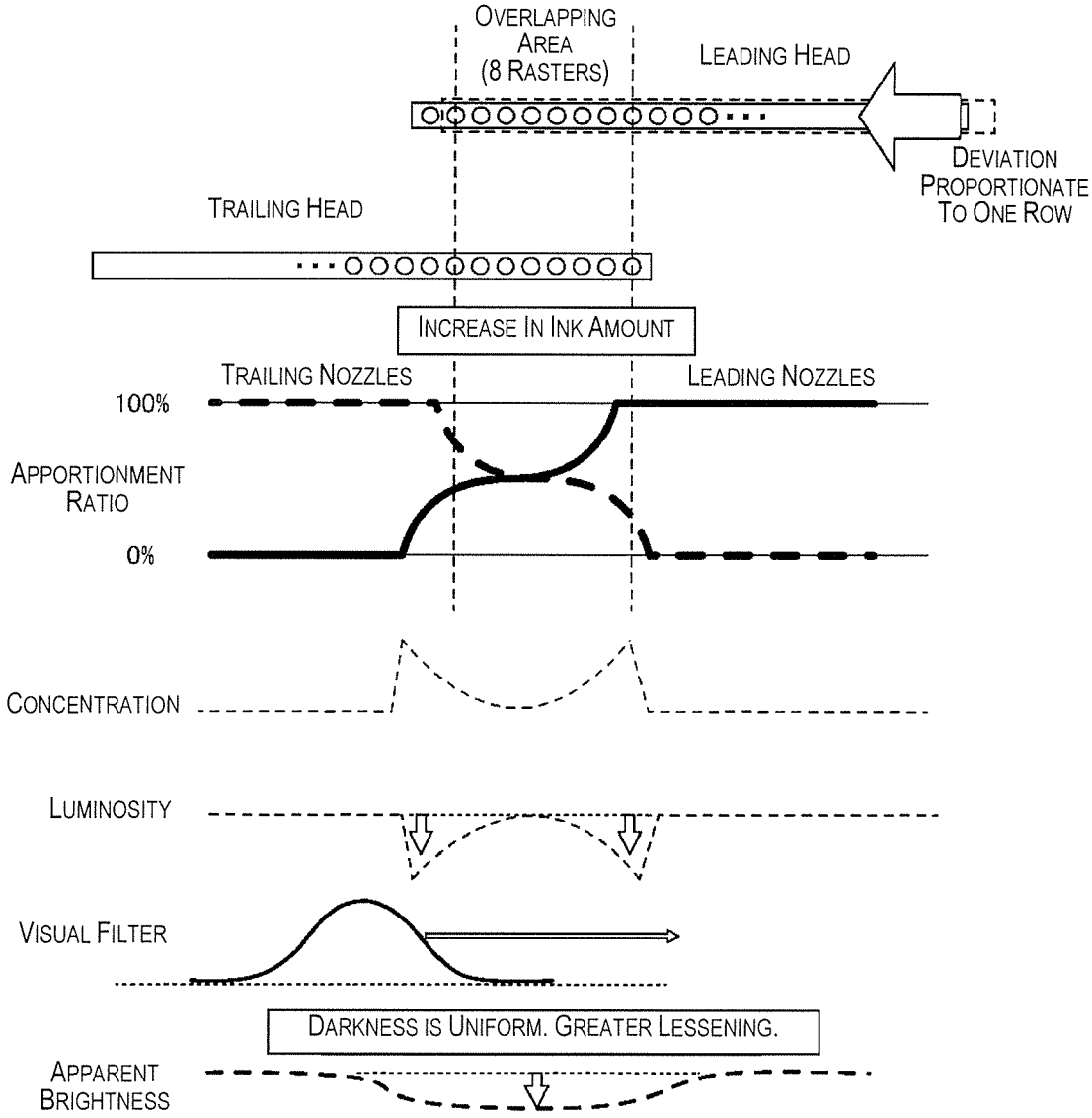
FIG. 9 is a diagram showing the luminosity of an image and the brightness when viewed with the naked eye (the apparent brightness) in a case of deviation in the attached positions of the heads in the printer 1 of the present embodiment.

FIG. 9 is a diagram showing the luminosity of an image and the brightness when viewed with the naked eye (the apparent brightness) in a case of deviation in the attached positions of the heads in the printer 1 of the present embodiment. In a case of relative deviation proportionate to one raster between the leading head and the trailing head, for example, the amount of ink in the overlapping image increases over that of the non-overlapping image, and the concentration of the image decreases (i.e., luminosity decreases), as shown in the diagram. In the printer 1 of the present embodiment, the increase in the ink amount in the overlapping image is dramatically greater in the ends of the overlapping image and less in the middle, as shown in FIG. 9. Specifically, the concentration of the overlapping image is less in the ends than in the middle (i.e., the luminosity of the overlapping image is less in the ends than in the middle). When the overlapping image and the non-overlapping image are viewed as a whole with the naked eye, they appear blurry depending on their visual features, and the darkness of the ends of the overlapping image is thereby blurred by the brightness of the non-overlapping image and the center of the overlapping image, whereby the overlapping darkness is lessened. Specifically, the concentration irregularity becomes inconspicuous due to the darkness of the ends of the overlapping image spreading peripherally outward.

In a case in which the attached positions of the heads deviate away in proportion to one raster between the leading head 320 and the trailing head 330, for example, the amount of ink in the overlapping image decreases below that of the non-overlapping image, and the concentration of the image decreases (i.e., the luminosity of the image increases, the image appears brighter). In such cases, due to the same mechanism described above, the overlapping image and the non-overlapping image appear blurry depending on their visual features when viewed as a whole with the naked eye, and the brightness of the ends of the overlapping image is therefore lessened by the blurring caused by the darkness of the non-overlapping image and the center of the overlapping image. Specifically, the concentration irregularity becomes inconspicuous due to the brightness of the ends of the overlapping image spreading peripherally outward.

As described above, when there is no deviation in the attached positions of the heads, there is no difference in effectiveness between the present embodiment and the prior art. However, when there is deviation in the attached positions of the heads, according to the present embodiment, concentration irregularity in the printed image can be made inconspicuous in comparison with cases where the prior art is used.

OTHER EMBODIMENTS

The embodiment described above primarily describes a printing system having a printer, but also includes the disclosure of a liquid (ink) ejection method or the like. The embodiment described above is intended to make the present invention easy to understand and should not be interpreted as limiting the present invention. As shall be apparent, the present invention can be modified and improved without deviating from the scope thereof, and the present invention includes equivalent items. Particularly, the embodiments described hereinbelow are included in the present invention as well.

In the embodiment described above, an inkjet printer was presented as an example of a liquid ejection device for implementing the liquid ejection method, but the device is not limited to this example. The present invention can be applied to various industrial devices other than printers (printing devices) as long as they are liquid ejection devices. For example, the present invention can also be applied to print devices for printing patterns on fabric, color filter manufacturing devices and display manufacturing devices for organic EL displays or the like, DNA chip manufacturing devices for coating chips with a solution of dissolved DNA to manufacture DNA chips, circuit substrate manufacturing devices, and the like.

The liquid ejection system may be a piezo system in which a voltage is applied to drive elements (piezo elements) and liquid is ejected by the expansion and compression of ink chambers, or a thermal system in which air bubbles are created in nozzles using heat-generating elements and liquid is ejected by the air bubbles.

In the embodiment described above, a line head inkjet printer having a head unit that does not move was described as an example of an inkjet printer, but the present invention is not limited to this example and can also be applied to a so-called serial printer in which the head unit does move, for example.

In the embodiment described above, a conveying unit which moves a medium (paper) relative to the head unit was described as an example of a movement mechanism for moving the medium (paper) in a predetermined direction (the movement direction) relative to the head unit. Specifically, the printer according to the embodiment described above was a printer in which the medium (paper) moves in the movement direction while the head unit does not, but the printer is not limited to this example. For example, the movement mechanism may be a mechanism which moves the head unit relative to the medium (paper; i.e., the printer may be designed so that the head unit moves in the movement direction but the medium (paper) does not).

The printer 1 according to the embodiment described above uses ink of a single color, but the printer is not limited to this embodiment and may use inks of multiple colors. For example, the printer 1 may use inks of the four colors black K, cyan C, magenta M, and yellow Y, in which case nozzles corresponding to the colored inks are disposed in alignment in the movement direction in the heads of the printer 1.

When a concentration correction process is added to the embodiment described above, the quality of the image further improves, which is more effective. This concentration correction process comprises a process of printing a test pattern on the medium, a process of reading the test pattern printed on the medium by a scanner or the like, a process of finding a correction value for correcting the concentration of the image in accordance with the read concentration, and a process of performing a concentration correction on the image on the basis of the found correction value.

In the embodiment described above, the apportionment ratio A and the apportionment ratio B for the nozzle groups #1 through #8 are shown in FIGS. 4 and 5, but are not limited to this example. In the embodiment described above, the relationship between the apportionment ratio A and the apportionment ratio B is given as A+B=100%, but is not limited to this example.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a head unit having a leading head and a trailing head;

a movement mechanism configured to move a medium in a movement direction relative to the head unit;

a leading nozzle row disposed in a first end of the leading head in an intersecting direction that intersects the movement direction, the leading nozzle row including a prescribed number of nozzles from a first nozzle to an mth nozzle aligned in sequence in the intersecting direction from a second end side to a first end side of the leading nozzle row;

a trailing nozzle row disposed in a second end of the trailing head in the intersecting direction, the trailing nozzle row including the prescribed number of nozzles from a first nozzle to an mth nozzle aligned in sequence in the intersecting direction from the second end side to the first end side of the trailing nozzle row so that the first nozzle through the mth nozzle of the trailing nozzle row are respectively positioned downstream in the movement direction from the first nozzle through the mth nozzle of the leading nozzle row; and a controller configured to control the head unit to eject liquid onto the medium moved by the movement mechanism at a first apportionment ratio from the nozzles of the leading nozzle row and at a second apportionment ratio from the nozzles of the trailing nozzle row corresponding to the leading nozzle row, and to form a raster line by arraying a plurality of dots along the movement direction, the controller being configured to change the first apportionment ratio so that the first apportionment ratio decreases sequentially from the first nozzle to the mth nozzle, and so that a change rate of the first apportionment ratio in the nozzles positioned at the first and second ends of the leading nozzle row is greater than the change rate of the first apportionment rate in the nozzles positioned in the middle of the leading nozzle row, and the controller being configured to change the second apportionment ratio so that the second apportionment ratio increases sequentially from the first nozzle to the mth nozzle, and so that a change rate of the second apportionment ratio in the nozzles positioned at the first and second ends of the trailing nozzle row is greater than the change rate of the second apportionment ratio in the nozzles positioned in the middle of the trailing nozzle row.

2. The liquid ejection device according to claim 1, wherein the controller is configured to decrease the change rates of the first apportionment ratio and the second apportionment ratio progressively from the nozzles positioned at the first end of the leading nozzle row and the trailing nozzle row towards the nozzles positioned in the middle of the leading nozzle row and the trailing nozzle row, and to increase the change rates of the first apportionment ratio and the second apportionment ratio progressively from the nozzles positioned in the middle of the leading nozzle row and the trailing nozzle row towards the nozzles positioned at the second end of the leading nozzle row and the trailing nozzle row.

3. A liquid ejection method comprising:

providing a movement mechanism configured to move a medium in a movement direction relative to a head unit including a leading head and a trailing head;

providing a leading nozzle row disposed in a first end of the leading head in an intersecting direction that intersects the movement direction, the leading nozzle row including a prescribed number of nozzles from a first nozzle to an mth nozzle aligned in sequence in the intersecting direction from a second end side to a first end side of the leading nozzle row;

providing a trailing nozzle row disposed in a second end of the trailing head in the intersecting direction, the trailing nozzle row including the prescribed number of nozzles from a first nozzle to an mth nozzle aligned in sequence in the intersecting direction from the second end side to the first end side of the trailing nozzle row so that the first nozzle through the mth nozzle of the trailing nozzle row are respectively positioned downstream in the movement direction from the first nozzle through the mth nozzle of the leading nozzle row;

ejecting liquid from the head unit onto the medium while the medium is moved relative to the head unit by the movement mechanism at a first apportionment ratio from the nozzles of the leading nozzle row and at a second apportionment ratio from the nozzles of the trailing nozzle row corresponding to the leading nozzle row, and forming a raster line by arraying a plurality of dots along the movement direction;

changing the first apportionment ratio so that the first apportionment ratio decreases sequentially from the first nozzle to the mth nozzle, and so that a change rate of the first apportionment ratio in the nozzles positioned at the first and second ends of the leading nozzle row is greater than the change rate of the first apportionment rate in the nozzles positioned in the middle of the leading nozzle row; and changing the second apportionment ratio so that the second apportionment ratio increases sequentially from the first nozzle to the mth nozzle, and so that a change rate of the second apportionment ratio in the nozzles positioned at the first and second ends of the trailing nozzle row is greater than the change rate of the second apportionment ratio in the nozzles positioned in the middle of the trailing nozzle row.

* * * * *